US007172273B2

(12) United States Patent
Ujita et al.

(10) Patent No.: US 7,172,273 B2
(45) Date of Patent: Feb. 6, 2007

(54) INK TANK

(75) Inventors: Toshihiko Ujita, Kanagawa (JP); Keisuke Matsuo, Kanagawa (JP); Kenji Kitabatake, Kanagawa (JP); Hiromasa Amma, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 10/845,934

(22) Filed: May 14, 2004

(65) Prior Publication Data

US 2004/0227795 A1 Nov. 18, 2004

(30) Foreign Application Priority Data

May 16, 2003 (JP) ..... 2003-139602

(51) Int. Cl.
*B41J 2/175* (2006.01)

(52) U.S. Cl. ..... 347/86

(58) Field of Classification Search ..... 347/84–85, 347/86, 87; 141/2, 18
See application file for complete search history.

(56) References Cited

U.S. PATENT DOCUMENTS

| | | | | |
|---|---|---|---|---|
| 5,040,002 | A * | 8/1991 | Pollacek et al. | 347/87 |
| 5,363,130 | A * | 11/1994 | Cowger et al. | 347/92 |
| 5,737,001 | A * | 4/1998 | Taylor | 347/85 |
| 5,764,259 | A * | 6/1998 | Nakajima | 347/86 |
| 6,364,471 | B1 * | 4/2002 | Seccombe | 347/85 |
| 6,394,593 | B1 * | 5/2002 | Komplin et al. | 347/86 |
| 6,585,358 | B2 * | 7/2003 | Usui et al. | 347/85 |
| 6,783,219 | B2 * | 8/2004 | Lui et al. | 347/86 |
| 6,945,641 | B2 | 9/2005 | Sakai et al. | 347/86 |

FOREIGN PATENT DOCUMENTS

| | | |
|---|---|---|
| CN | 1354088 | 6/2002 |
| CN | 1390705 | 1/2003 |
| JP | A 4-144755 | 5/1992 |
| JP | 2002-103648 | 4/2002 |
| JP | 2003-25600 | 1/2003 |

OTHER PUBLICATIONS

English Concise Explanation for CN 1390705.
English Abstract for CN 1354088.
Chinese Office Action, dated Mar. 24, 2006, in corresponding Chinese patent application.
Office Action dated May 23, 2006 from Japanese Patent Office in corresponding Japanese Patent Application No. 2003-139602.
Concise Explanation of Reference 1 (JP 2003-25600).
Concise Explanation of Reference 2 (JP 2002-103648).

* cited by examiner

*Primary Examiner*—Anh T. N. Vo
(74) *Attorney, Agent, or Firm*—Morgan & Finnegan LLP

(57) ABSTRACT

An ink tank in which an air communication passage and a pressure regulator valve passage are formed by covering grooves, etc., with a film is fabricated in a simple manufacturing process. Specifically, an atmosphere communication hole and a major part of an air communication passage are formed in the same surface on which a film for forming a valve passage is attached. By virtue of this, the process of attaching a major part of the air communication passage film and the process of attaching the valve film can be performed in a single process step. This simplifies the process of attaching the films.

4 Claims, 15 Drawing Sheets

INK TANK

This application claims priority from Japanese Patent Application No. 2003-139602 filed May 16, 2003, which is incorporated hereinto by reference.

BACKGROUND OF THE INVENTION

1. Field of the Invention

The present invention relates to an ink tank and, in particular, to a configuration of an air communication passage for establishing a communication of the inside of an ink reserving chamber of an ink tank with outside air.

2. Description of the Related Art

An air communication passage is used for establishing a communication of the inside of a reserving chamber of an ink tank with the outside of the tank, and thereby relieving an increase in the negative pressure caused by a decrease in the amount of ink in the reserving chamber occurring along with the consumption of the ink. This mechanism continuously ensures an appropriate ink supply. Further, even when the pressure in the ink reserving chamber increases or decreases owing to a change in the temperature, etc., of the environment, this pressure change can be similarly alleviated via a the air communication passage.

By the way, since the air communication passage establishes the communication of the ink reserving chamber with the outside air, the passage basically allows the ink solvent to evaporate therethrough. This ink evaporation causes a problem such as an increase in the concentration of the ink color material and solidification of the ink. Further, for example, in a case where a strong impact acts on the ink tank and thereby causing a sudden pressure change in the reserving chamber, the ink may leak via the passage. In order to reduce such ink evaporation and prevent such ink leakage, a configuration is known where an absorber or an air-permeable membrane is provided in a part of the air communication passage. Another configuration is also known where an air communication passage is formed in the shape of a thin and long passage, which maybe used in addition to or independently of preceding configuration.

From the perspective of space permitting the formation of such a particularly long passage in an ink tank, Japanese Patent Application Laid-open No. 4-144755(1992) describes a configuration where a communication passage is formed in an upper cover serving as a case member forming a reserving chamber of an ink tank. More specifically, an air vent hole is formed in the upper cover therethrough to communicate with the reserving chamber. Then, an air vent groove is formed along the surface of the upper cover therein such that the one end of the groove is connected to the air vent hole. Then, a seal member is attached onto the upper cover such as to cover the air vent groove except for the other end thereof used as a vent hole for a communication with the outside air. As a result, a long communication passage is formed.

In an ink tank of the type where ink is stored as it is without any ink absorber in the ink reserving chamber, a configuration is known where ink is supplied to a printing head by means of a pressure regulator valve (hereinafter, referred to simply as a valve, in some cases) having a simple configuration. In the ink tank of this type, the ink passage extending from the ink reserving chamber through the pressure regulator valve to an ink outlet may be formed in the shape of a relatively long passage in some cases. The purpose of this is that the flow resistance in such a long passage assists the function of the simple pressure regulator valve so as to generate a negative pressure (dynamic negative pressure) during ink supply, or alternatively that the above-mentioned passage is formed at the bottom of the ink tank for using the ink all up.

Also in such a relatively long ink passage extending from the ink reserving chamber to the ink outlet, from the perspective of space permitting its formation, a part of the passage may be formed similarly to the above-mentioned air communication passage, that is, by forming a groove in a case member of the ink tank and then covering it with a film. However, the film is attached to the case member generally by fusion bonding, etc. This requires a great amount of labor in comparison with other processes such as ink injection and valve insertion in the ink tank manufacturing. Thus, the formation of the air communication passage and the ink passage by attaching a seal or a film onto a case member having grooves formed thereon has a problem that the number of manufacturing processes increases and hence necessary labor increases particularly.

SUMMARY OF THE INVENTION

An object of the invention is to provide an ink tank, in which an air communication passage and a passage for a pressure regulator valve are formed by covering grooves, etc., with a film, and thus which can be manufactured in particularly simple processes.

In the first aspect of the present invention, there is provided an ink tank having a supply outlet for supplying ink, a reserving chamber storing ink to be supplied via said supply outlet, and a pressure regulator valve located inside a passage connecting said reserving chamber with said supply outlet to operate on the basis of a pressure difference between the reserving chamber side and the supply outlet side, said ink tank comprising:

a pressure regulator valve passage that is formed of a concave portion formed in one surface of said ink tank for forming said pressure regulator valve passage and of a film attached to said one surface so as to cover said concave portion;

an air vent formed to communicate with said reserving chamber through a case member from which said ink tank is composed; and an air communication passage that is formed of a groove one end of which connects with said air vent, said groove being formed in and along a surface on which said air vent is formed and said one surface of said ink tank, and of a film attached to said surfaces of said ink tank so as to cover said air vent and said groove, except other end of said groove.

According to the above configuration, the surface of the ink tank onto which a film is attached so as to form a passage for a pressure regulator valve is the same as the surface onto which a part of a film is attached so as to form an air communication passage. Thus, these two processes of attaching the two films are performed in a single process step of attaching the films onto a single surface, and hence the position setting, etc., in a film fusion bonding device is simplified.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention are described below in detail with reference to the drawings.

The embodiments of the present invention relate to ink tanks of cartridge types. Thus, the basic configuration and operation of such ink tanks common to the following embodiments are described below first.

Figure 5:
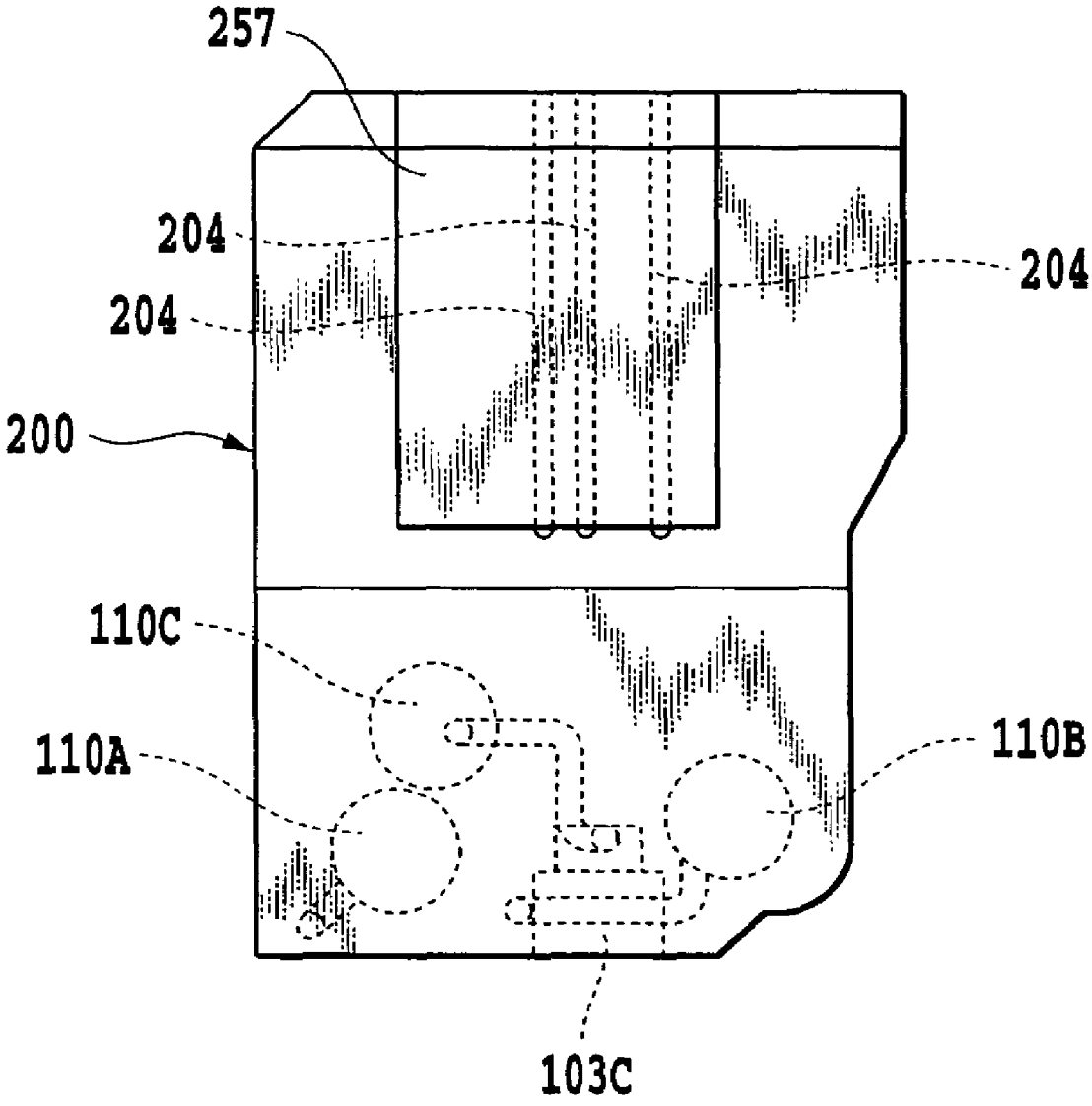
FIG. 5 is a front view showing the basic configuration of an ink tank for storing ink of plural colors according to an embodiment of the invention.
Figure 6:
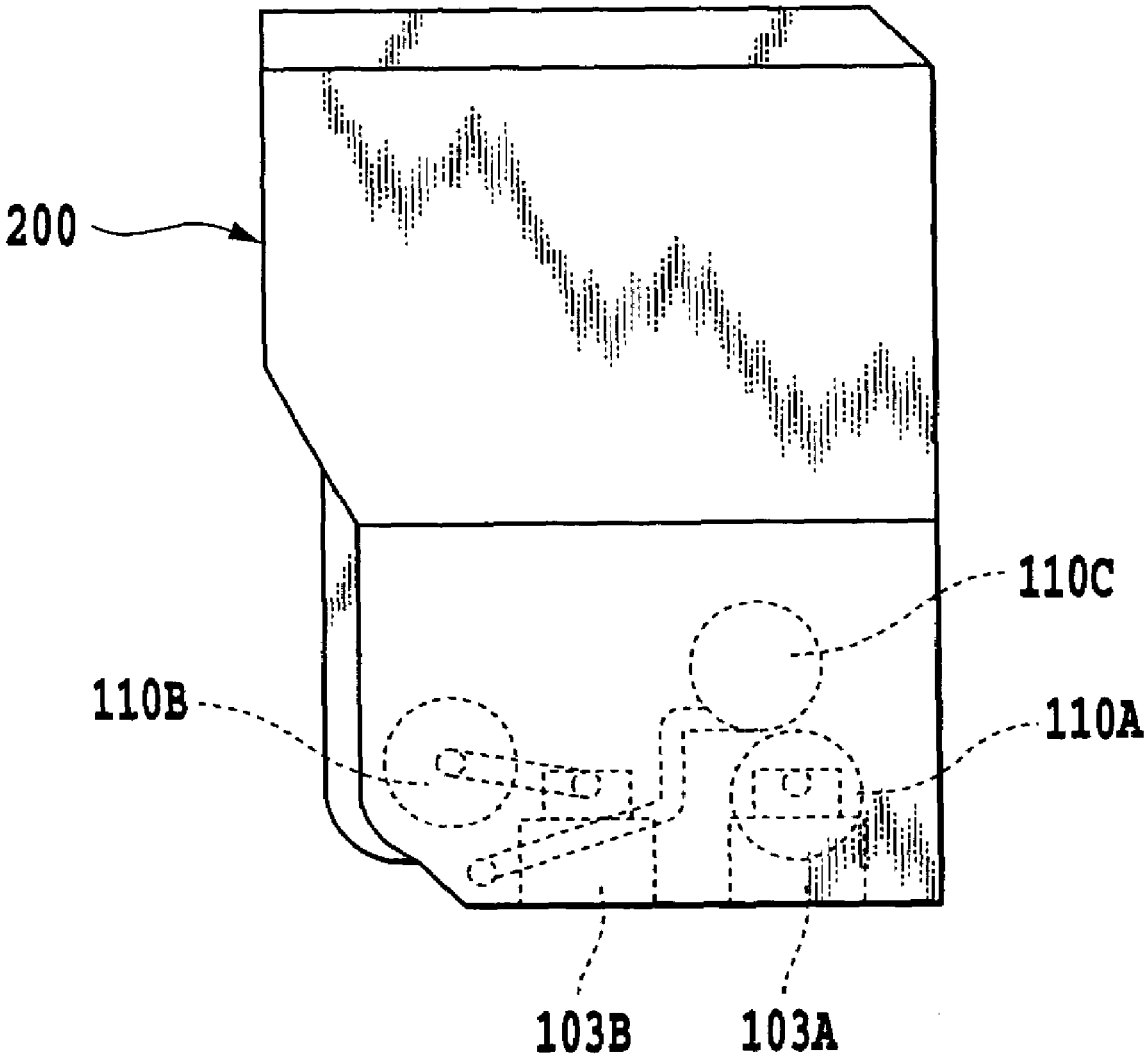
FIG. 6 is a rear view of an ink tank of FIG. 5.
Figure 7:
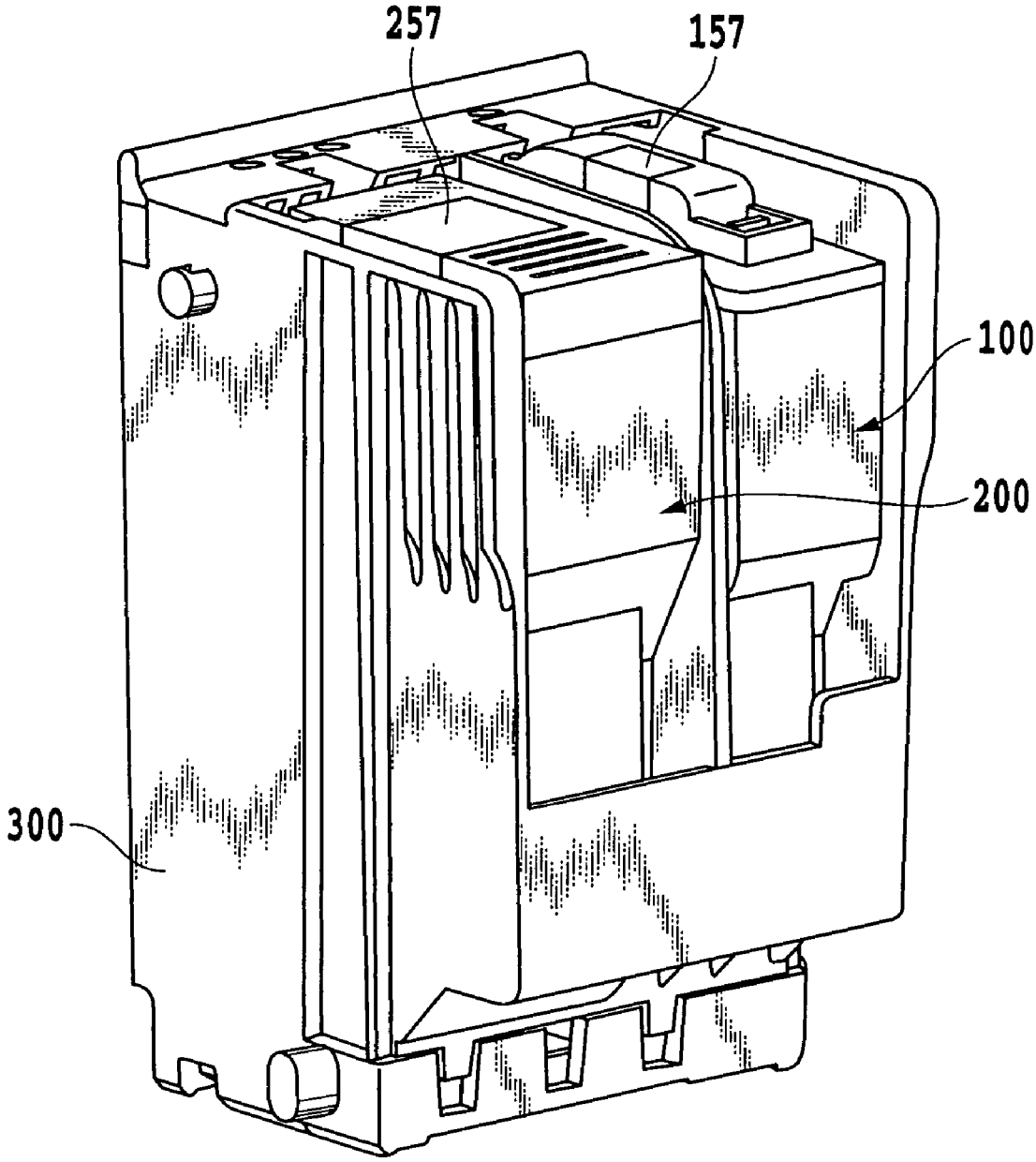
FIG. 7 is a perspective view showing a head cartridge onto which an ink tank of FIG. 1 or 6 can be mounted.
Figure 8:
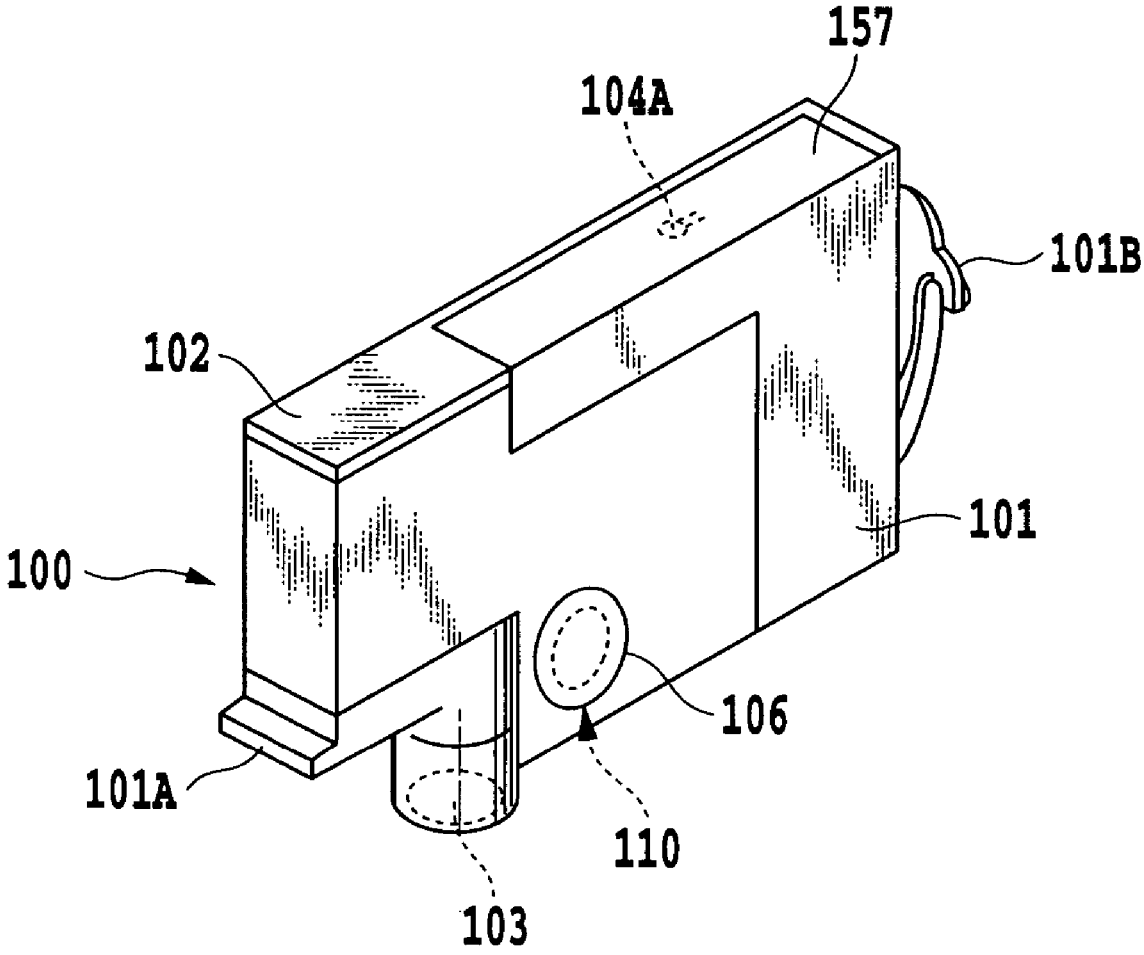
FIG. 8 is a view illustrating another example of configuration of an ink tank for storing ink of a single color.

FIG. 1 through FIG. 4 are diagrams illustrating the basic configuration of an ink tank 100 for storing ink of a single color (black ink in the embodiment). FIG. 5 and FIG. 6 are diagrams illustrating the basic configuration of an ink tank 200 for storing ink of plural colors (magenta ink, cyan ink, and yellow ink in the embodiment). FIG. 7 is a perspective view of a head cartridge 300 capable of joining with the ink tank 100 or 200. FIG. 8 is a diagram illustrating another example of configuration of an ink tank 100 for storing ink of a single color.

Figure 1:
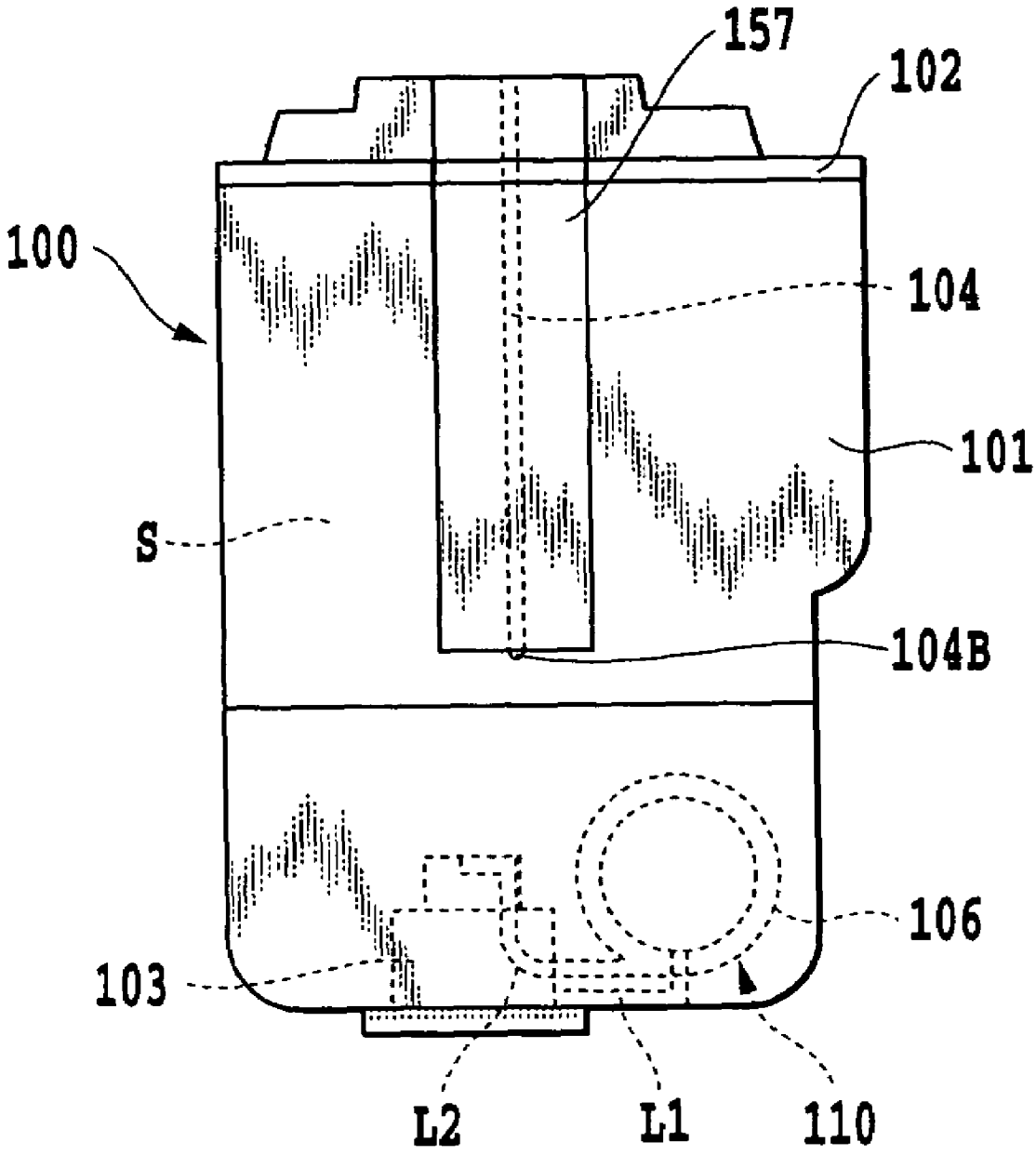
FIG. 1 is a front view showing the basic configuration of an ink tank for storing ink of a single color according to an embodiment of the invention.
Figure 2:
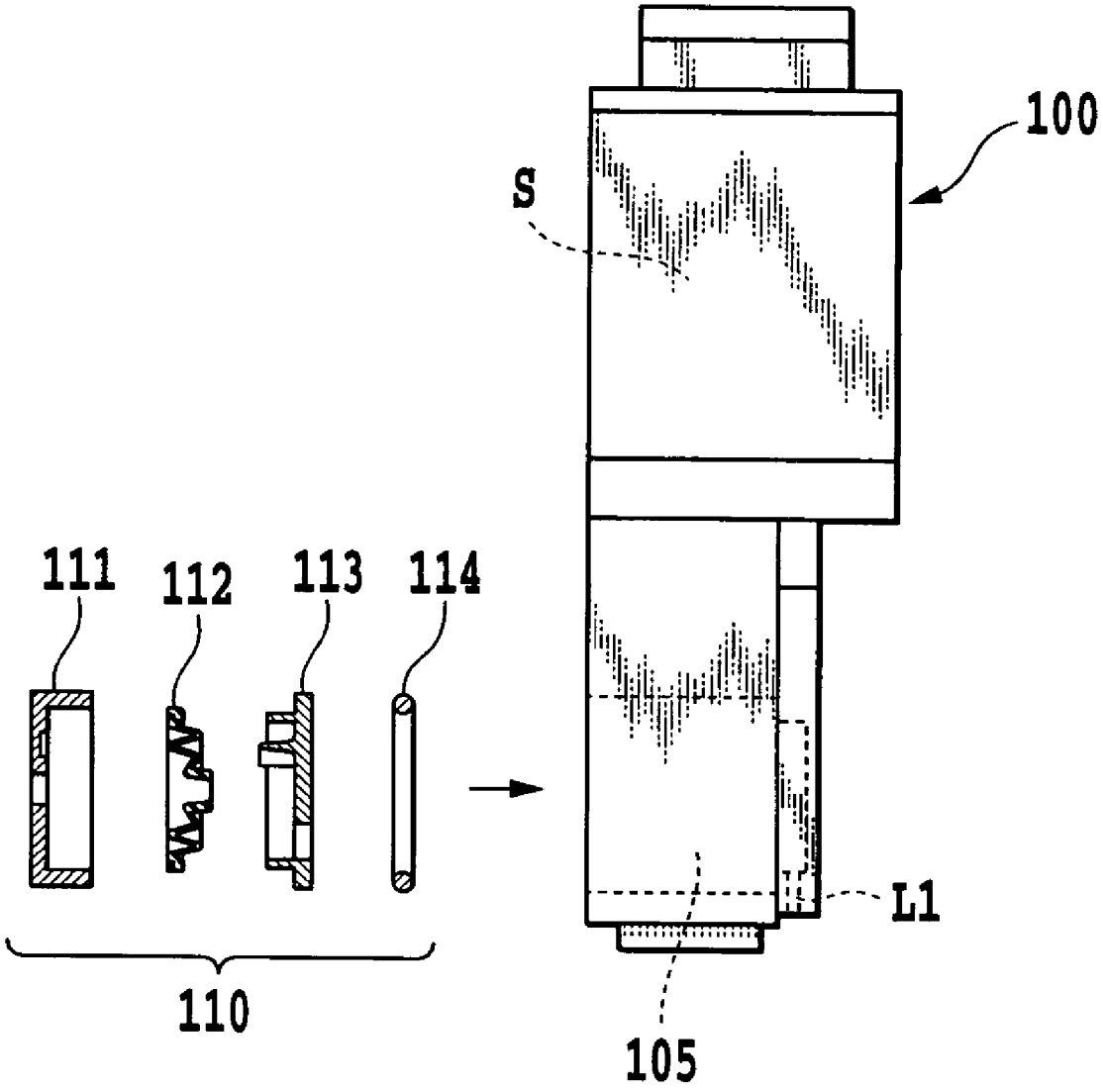
FIG. 2 is a side view of an ink tank of FIG. 1.
Figure 3:
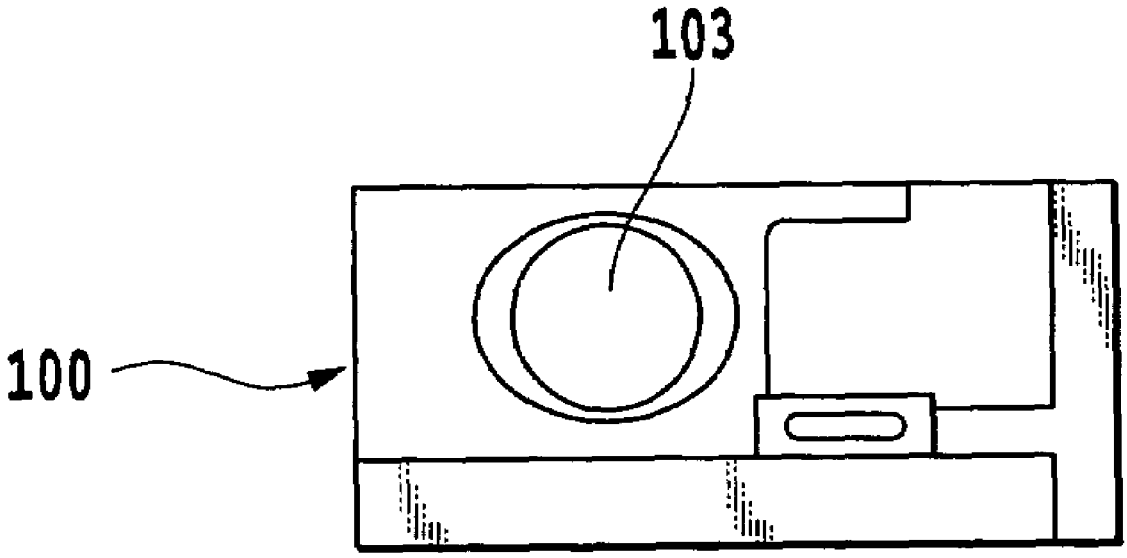
FIG. 3 is a top view of an ink tank of FIG. 1.
Figure 4:
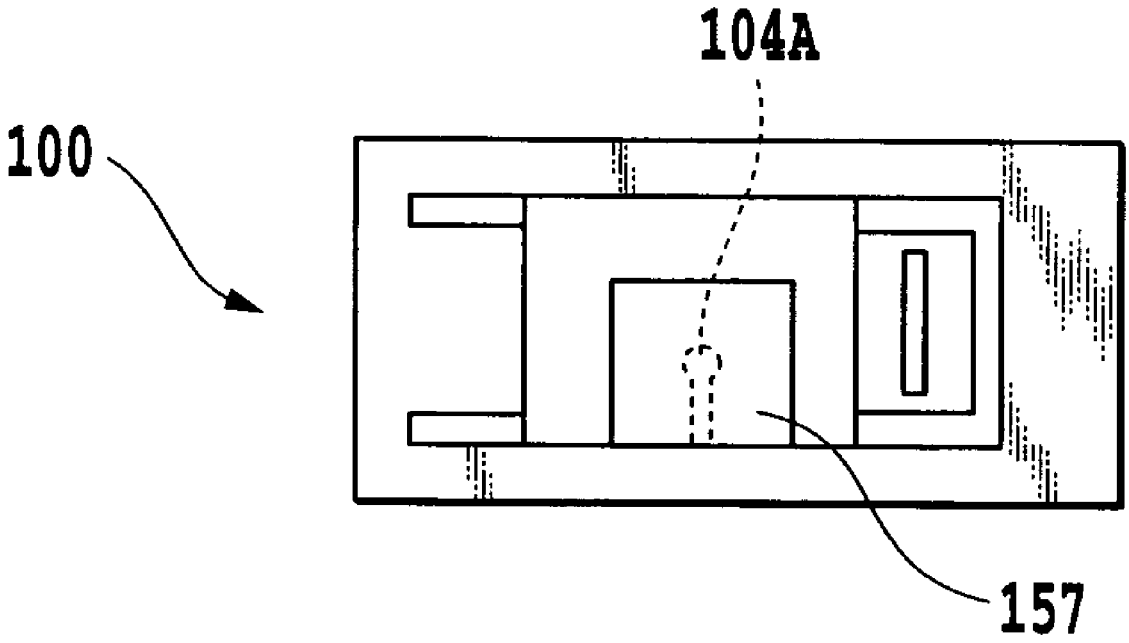
FIG. 4 is a bottom view of an ink tank of FIG. 1.

In the ink tank 100 of FIG. 1 through FIG. 4 for storing ink of a single color, a cover 102 is joined to a case 101, so that an ink storage space S is formed. The storage space S communicates with an ink supply outlet 103 via a passage. Further, in the middle of the passage, the ink tank 100 is provided with a valve 110 serving as a pressure-actuated (pressure regulator) valve which operates on the basis of a pressure difference between a storage space side and an ink supply outlet side. The storage space S also communicates with the outside air via an air communication passage 104. A valve chamber 105 is formed in a part of the case 101. Inside the valve chamber, a housing 111, a valve rubber 112, a flange 113, and an o-ring 114 are assembled into the valve 110, and then the valve 110 is formed. In FIG. 2, the valve chamber 105 communicates with the storage space S via a passage L1 on the right hand side, and with the ink supply outlet 103 via a passage L2 (not shown by FIG. 2) on the left hand side. As such, the valve 110 inside the valve chamber 105 is located in the middle of the ink supply passage between the storage space S and the supply outlet 103. In FIG. 2, an opening on the left hand side of the valve chamber 105 is air-tightly sealed by a valve film 106 fusion-bonded onto the surface of the case 101. At the same time, the valve film 106 forms the passage L2. More specifically, the passage L2 is formed by forming a groove along a surface of the case 101 and then fusion-bonding a valve film 106 onto the surface of the case 101 such as to cover the groove.

As described below in the following each of embodiments, the air communication passage 104 for establishing the communication of the storage space S serving as an ink reserving chamber with the outside is formed by: forming an air vent hole 104A communicating with the storage space S through the cover 102; then forming a groove which is connected to this hole and extends along the surfaces of the cover 102 and the case 101; and then fusion-bonding a film 157 onto the cover 102 and the case 101 such as to cover the groove.

The ink tank 100 having the above described configuration is mounted onto a printing apparatus in a condition that the tank 100 is mounted onto a head cartridge 300 as shown in FIG. 7. In a printing apparatus of a serial scan type, the ink tank 100 together with the head cartridge 300 is mounted on a carriage that travels in a main scan direction. The head cartridge 300 comprises a printing head for ejecting the ink supplied from the storage space S of the ink tank 100 via the valve 110 and the supply outlet 103. This printing head may be of various types such as those using an electro-thermal converter (heater) or a piezoelectric element for ejecting the ink. When an electro-thermal converter is used, the heat energy generated by the converter generates bubbles in the ink, so that the bubbling energy ejects the ink through the ejection opening.

The valve 110 operates basically as follows. Normally, the valve rubber 112 closes the ink supply passage between the storage space S and the supply outlet 103 by means of the elasticity of the valve rubber. When the negative pressure of the ink on the supply outlet 103 side exceeds a predetermined value owing to the ejection of the ink in the printing head, the valve rubber 112 deforms and opens the ink supply passage. As a result, the ink is supplied from the storage space S side to the supply outlet 103 side, and then the negative pressure on the supply outlet 103 side returns to a predetermined value or below, so that the valve rubber 112 closes the ink supply passage again. Such basic operation of the valve 110 achieves satisfactory ink supply to the printing head.

The ink tank 200 of FIG. 5 and FIG. 6 for storing ink of plural colors has a configuration similar to that of the above-mentioned ink tank 100. More specifically, ink storage spaces for storing three kinds of ink are formed inside the ink tank 200. The storage spaces respectively communicate with supply outlets 103A, 103B, and 103C via valves 110A, 110B, and 110C serving as pressure regulator valves. In the present embodiment, two valves 110A and 110B are arranged on one side surface of the ink tank 200, while one valve 110C is arranged on the other side surface. The three kinds of ink supplied from the respective storage spaces in the ink tank 200 through the valves 110A, 110B, and 110C and the supply outlets 103A, 103B, and 103C are fed to respective printing heads in the head cartridge 300 (see FIG. 7), and then ejected. The valves 110A, 110B, and 110C perform basic operations similar to that of the valve 110 in the ink tank 100 shown in FIG. 4, etc., so as to achieve satisfactory ink supply to the printing heads.

The ink tank 100 shown in FIG. 8 according to another embodiment for storing ink of a single color is mounted on a head cartridge of a type different from the head cartridge of FIG. 7. In FIG. 8, a case 101 is provided with an engagement claw 101A and a latch lever 101B for engaging with the head cartridge. Other parts are the same as the configuration of the ink tank of FIG. 1 through FIG. 4.

Described below are embodiments of the configuration of the air communication passage in the ink tanks having the above-mentioned basic configurations.

(Embodiment 1)

Figure 9B:
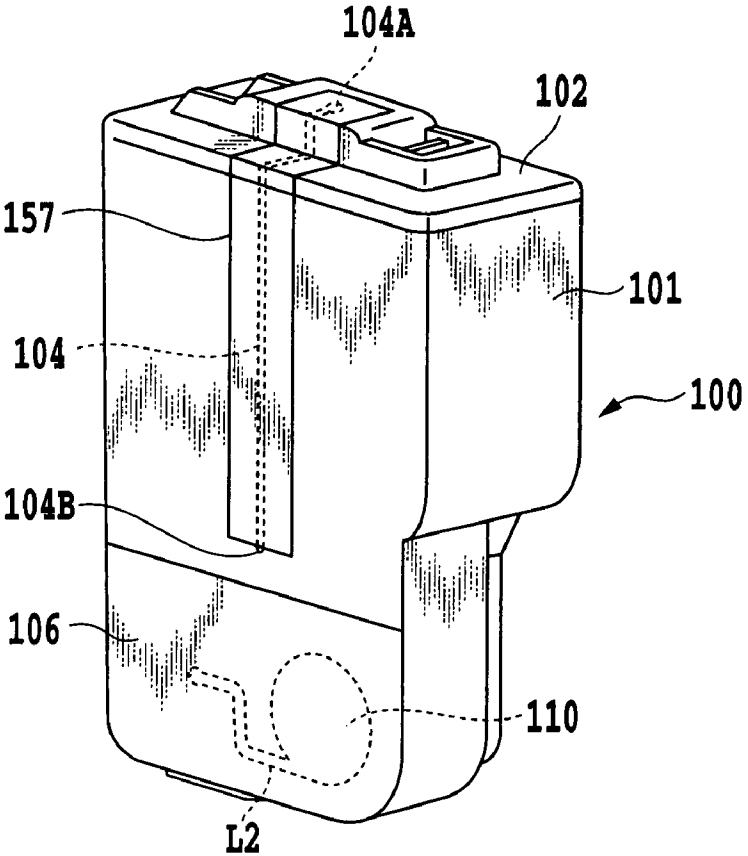
FIG. 9A and FIG. 9B are perspective views showing an ink tank for black ink according to a first embodiment of the present invention.
Figure 9A:
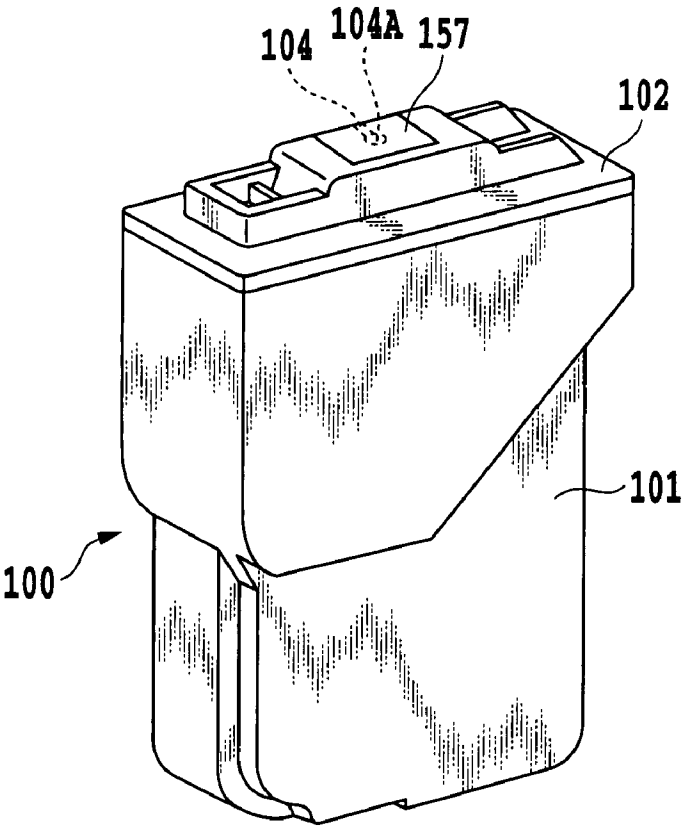

FIG. 9A and FIG. 9B are perspective views showing an ink tank (hereinafter, referred to as an ink cartridge, in some cases) 100 for black ink according to a first embodiment of the present invention. These figures show in particular details of the air communication passage of the ink cartridge 100 described for FIG. 1 through FIG. 3. Among the surfaces of the cartridge 100, FIG. 9A mainly shows the rear surface on which no valve film 106 is attached, while FIG. 9B mainly shows the front surface on which a valve film 106 is attached.

As shown in FIG. 9B, on the surface of the ink cartridge on which a valve film 106 is attached, a passage (a concave portion) for a valve 110 serving as a pressure regulator valve and an ink passage L2 communicating therewith are formed by attaching the film. Further, a major part of an air communication passage 104 is formed on the surface on which the valve film 106 is attached. More specifically, an air vent hole 104A communicating with an ink reserving chamber (storage space) S inside the cartridge 100 is formed through the cover 102 serving as a case member of the cartridge. This is because when the cartridge 100 is used and mounted on the cartridge of a printer, the cover 102 is positioned on top (that is, in the posture shown in the figure). In this position, the gas inside the storage space S is located above stored ink, and hence a communication via the air vent hole 104A can be achieved by the gas.

Further, a groove 104 (denoted by the same reference numeral as that of the air communication passage) is formed starting at the air vent hole 104A and along and across a surface of the cover 102. Furthermore, a continuous groove 104 in connection with preceding groove is similarly formed vertically along one surface of the case 101 comprising a case member, such as to extend to the position of approximately ⅓ of the case 101. Then, a single film 157 is attached such as to cover a region that includes and is along the air vent hole 104A and the groove 104. At this time, the other end of the groove 104 is not covered by the film 157, so as to form an atmosphere communication hole 104B exposed to the outside air.

As described above, a groove is formed in and along a surface of a case member, and then a film is attached such as to cover the groove, so that an air communication passage is formed. In the present embodiment, the two end holes of the air communication passage 104, that is, the air vent hole 104A in direct communication with the storage space S and the atmosphere communication hole 104B opened to the outside, are formed in separate surfaces of the cartridge 100. That is, the atmosphere communication hole 104B and a major part of the air communication passage 104 are formed on the surface on which the valve film 106 is attached. By virtue of this, the process of attaching a major part of the air communication passage film 157 and the process of attaching the valve film 106 can be performed in a single process step. This simplifies the process of attaching the films.

Further, in the present embodiment, the film 157 and the valve film 106 are attached by fusion bonding. Thus, the process of attaching the films including the fusion bonding processing is simplified. For example, a fusion bonding device may be set relative to the same surface of the ink cartridge 100, so that the valve film 106 and a major part of the film 157 may be attached. Further, in the present embodiment, the valve film 106 and the air communication passage film 157 are composed of the same material. This permits the heater power, etc., of the fusion bonding device to beset the two films. In the present embodiment, the valve film 106 and the film 157 are composed preferably of a material which has no permeability for the ink solvent and little permeability for gas and which is suitable for fusion bonding. It should be noted that the portion of the film 157 corresponding to the cover 102 is attached similarly by fusion bonding.

Figure 10B:
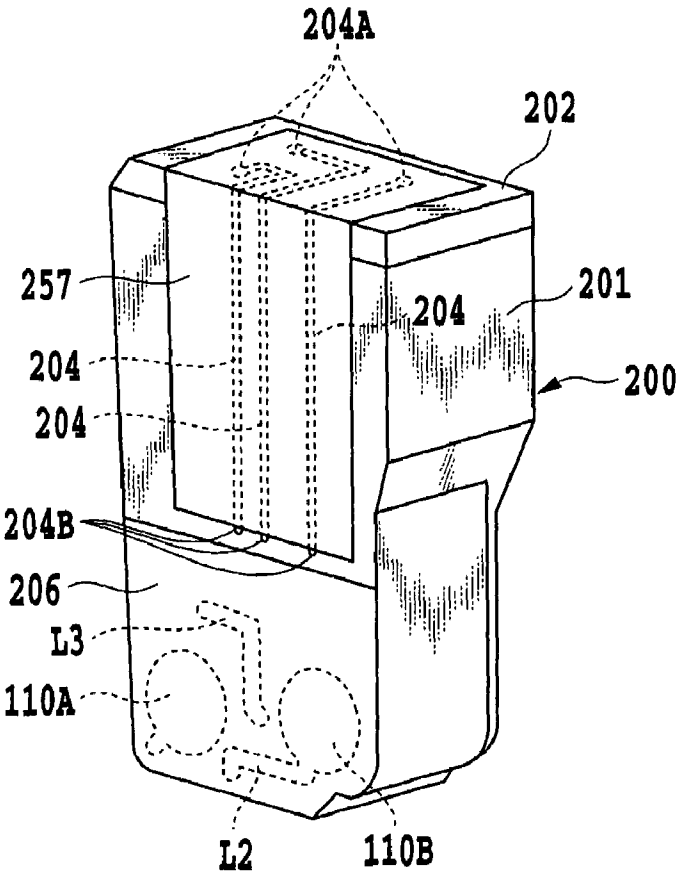
FIG. 10A and FIG. 10B are views showing details of air communication passages in an ink cartridge according to the first embodiment.
Figure 10A:
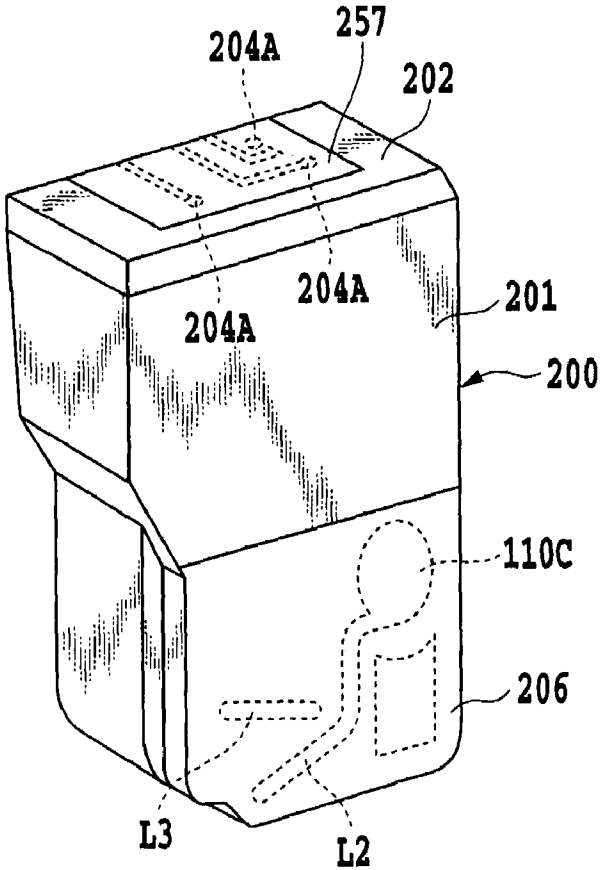

FIG. 10A and FIG. 10B are diagrams showing details of air communication passages in the ink cartridge 200 described for FIG. 5 and FIG. 6 for storing the ink of cyan, magenta, and yellow.

In the present embodiment, as shown in these figures, a major part of an air communication passage film 257 is attached on the surface on which a valve film 206 for forming valves 110A and 110B for cyan and yellow and their passages is attached. When the film 257 is attached, an air communication passage is formed that has an end at an air vent hole 204A formed through the cover 202 and the other end at a communication hole 204B opened to the atmosphere.

As described above, in the first embodiment of the present invention, in a configuration that the air communication passage is formed in a relatively long shape, so as to reduce the evaporation of the ink solvent and to prevent ink leakage, the air communication passage is formed such as to extend to a surface of the cartridge different from one having the air vent hole therein. By virtue of this, the process of attaching the films is simplified as described above. Further, the groove can be formed in a shape closer to a straight line in comparison with the case of Japanese Patent application Laid-open No. 4-144755(1992), etc., where a long communication passage is formed within a surface. This simplifies the configuration of the mold die, etc., for fabricating the groove.

(Embodiment 2)

Figure 11B:
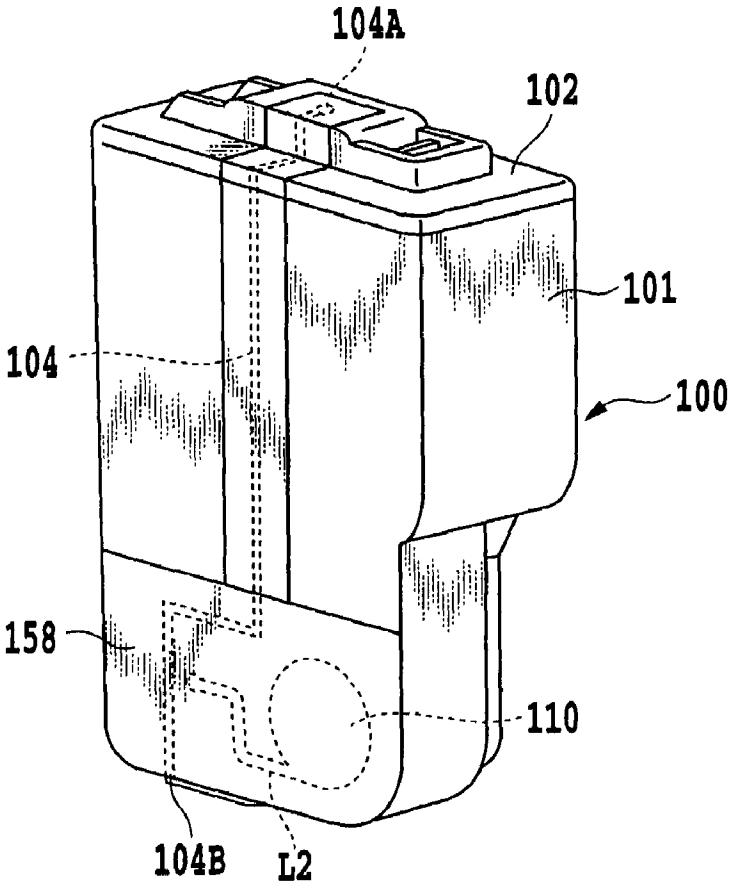
FIG. 11A and FIG. 11B are perspective views showing a black ink cartridge according to a second embodiment of the present invention.
Figure 11A:
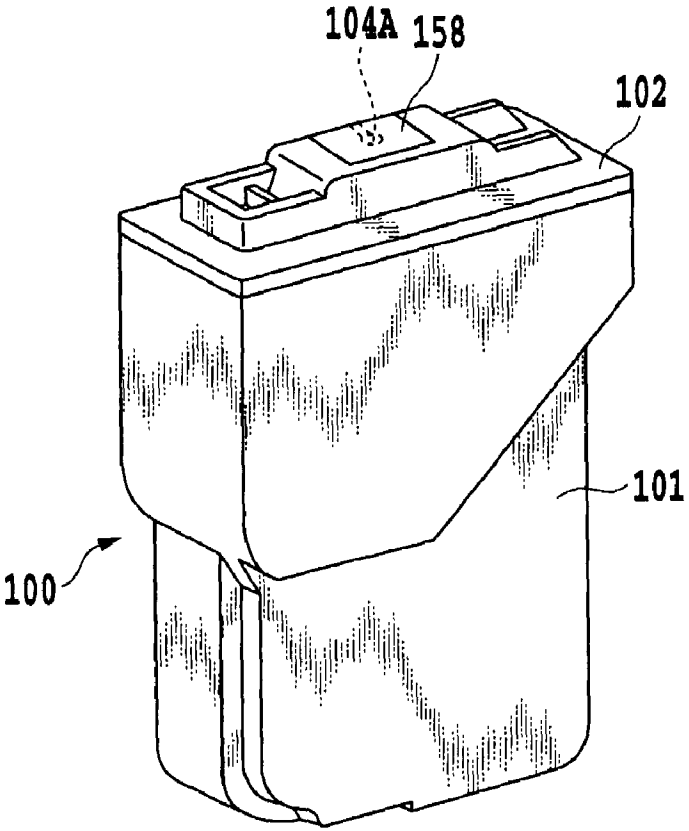
Figure 12B:
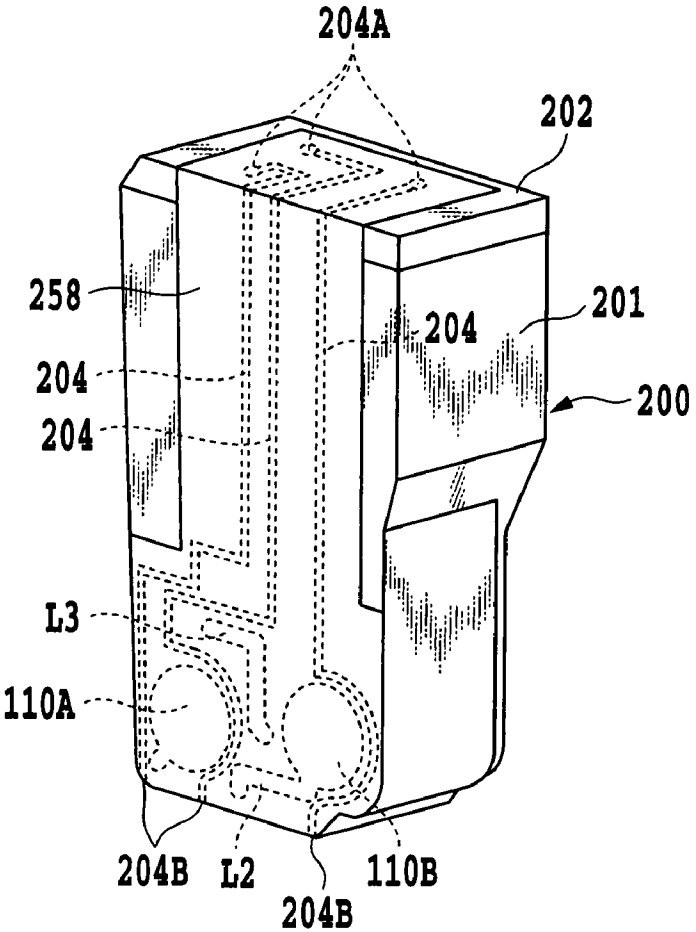
FIG. 12A and FIG. 12B are perspective views showing an ink cartridge for cyan, magenta, and yellow ink according to the second embodiment.
Figure 12A:
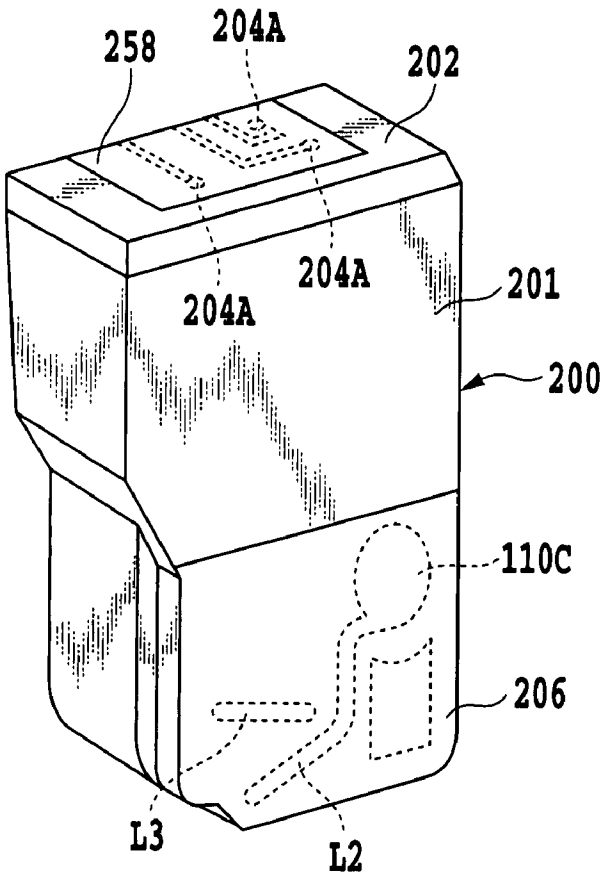

A second embodiment of the present invention relates to the integration of the film for forming the valve passage with the film for forming the air communication passage. FIG. 11A and FIG. 11B are diagrams similar to FIG. 9A and FIG. 9B and show a black ink cartridge according to the present embodiment. FIG. 12A and FIG. 12B are diagrams similar to FIG. 10A and FIG. 10B and show an ink cartridge for cyan, magenta, and yellow according to the present embodiment.

As shown in FIG. 11B, a groove 104 has an end at an air vent hole 104A formed through a cover 102 similarly to the above-described embodiment, then goes across the cover 102 into one side surface of the cartridge case 101, and then extends along the side surface so as to reach the bottom end. As such, in the present embodiment, the groove 104 is not terminated in the middle of the side surface, but reaches the bottom end. Then, a single film 158 is attached such as to cover the region along the groove 104, together with the valve 110 and its passage L2. As a result, an air communication passage 104 is formed starting at a portion of the cover 102 and reaching the bottom end of the side surface of the cartridge case. At that time, a communication hole 104B (not shown) opened to the atmosphere is formed by the film 158 and the groove 104 at an edge of the bottom surface of the cartridge 100, a portion of which corresponds to the above-mentioned bottom end.

The ink cartridge 200 of FIG. 12A and FIG. 12B in which the respective reserving chambers for ink of cyan, magenta, and yellow are integrated into a single unit has a configuration similar to FIG. 11A and FIG. 11B. More specifically, an air vent hole 204A is formed for each ink color in a cover 202. Then, each groove 204 having an end at each hole is formed in and along a surface of the cover 202 and a surface of a cartridge case 201. Then, a single film 258 is attached to these air vent holes 204A and grooves 204, as well as to the portion corresponding to the valves 110A and 110B for ink of cyan and yellow, so that communication holes 204B (not shown) corresponding to the respective ink colors are formed in the bottom surface of the cartridge 200. As shown in FIG. 12A, a film 206 for forming a valve 10C corresponding to the magenta ink is arranged separately from the air communication passage similar to the first embodiment.

As described above, according to the present embodiment, the same effect as that of above-described the first embodiment is obtained. In addition, since the air communication passage film and the valve film are integrated, the process of film attachment by fusion bonding, etc., is further simplified.

Further, the communication hole opened to the atmosphere is arranged in the cartridge bottom surface where the ink supply outlet is formed. Thus, even in a case where the ink leaks from the communication holes 204B to the outside, the leaked ink is prevented to significant degree from attaching to the user. More specifically, since the bottom surface is provided with the ink supply outlet for connecting to the printing head, the user pays excessive attention to blotting at the bottom surface in the handling of the cartridge such as the mounting and dismounting of the ink cartridge. Thus, even in a case of ink leakage through the communication holes 204B, the possibility is reduced that the leaked ink attaches to the user.

(Embodiment 3)

Figure 13:
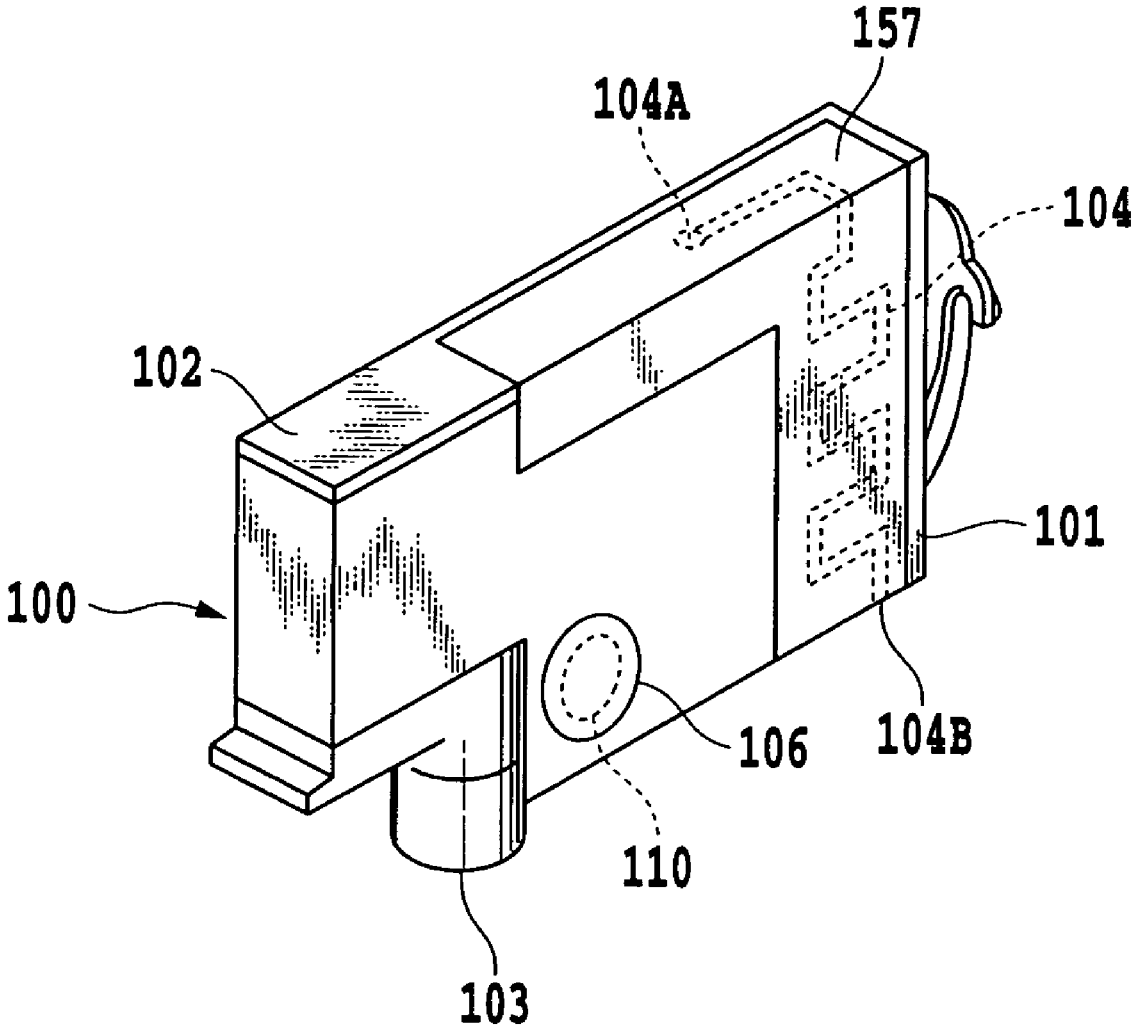
FIG. 13 is a perspective view showing details of an air communication passage in an ink cartridge according to a third embodiment different from that of the first and second embodiments.

An ink cartridge of FIG. 13 according to the present embodiment has a configuration different from that of the first and second embodiments. FIG. 13 is a perspective view showing details of an air communication passage in the ink cartridge described for FIG. 8. This cartridge is used for ink of a single color. However, the configuration is similar even for black ink or another color.

The air communication passage shown in FIG. 13 has a configuration similar to the first embodiment shown in FIGS. 9A, 9B and FIGS. 10A, 10B, with respect to the film for forming the passage. More specifically, the film 157 for forming the air communication passage 104 is separate from the film 106 for forming the valve 110. However, in contrast to the first embodiment, the groove 104 extends to the bottom surface of the cartridge 100 similar to the second embodiment, so that the communication hole 104B opens at an edge of the bottom surface. Thus, the ink cartridge according to the present embodiment has the same effect as that of the first embodiment with respect to process simplification.

As seen from FIG. 13, the air communication passage 104 according to the present embodiment generally has a zigzag shape, since the passage is formed in the side surface of the case 101 not only vertically but also horizontally viewed in the figure. By virtue of this, even when the cartridge in the position shown in the figure is rotated by 90 degrees within the plane containing the zigzag passage, and even when leaked ink is already present in the communication passage owing to pressure-relevant trouble in the reserving chamber, the zigzag passage causes the ink in the passage to stay in the lower portion of the passage, and prevents the ink from moving further along the passage. This prevents the leakage of the ink via the communication hole 104B to the outside.

(Embodiment 4)

Figure 14:
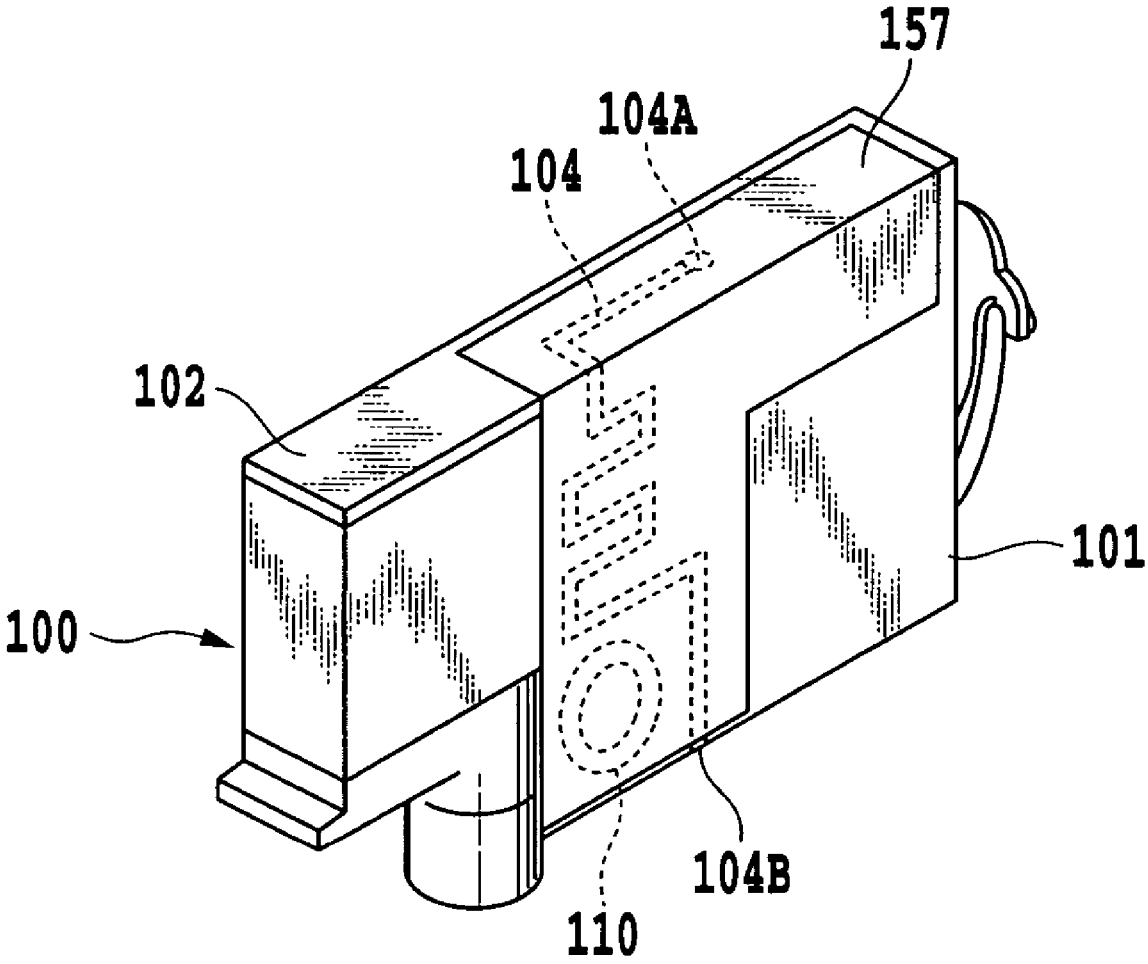
FIG. 14 is a perspective view showing an ink cartridge according to a fourth embodiment of the present invention.

FIG. 14 is a perspective view showing an ink cartridge according to a fourth embodiment of the present invention.

As shown in FIG. 14, the present embodiment relates to the integration of the film for forming the air communication passage with the film for forming the valve passage in the ink cartridge of above-mentioned the third embodiment. More specifically, a single film 157 is attached such as to cover: an air vent hole 104A formed in a cover 102; a groove 104 starting at this air vent hole; an additional groove 104 in connection with preceding groove and formed in a surface of a case 101; and a valve 110 passage groove formed in the same side surface. A zigzag shape of the air communication passage 104 in the side surface of the case 101 is the same as that of the third embodiment.

(Embodiment 5)

Figure 15B:
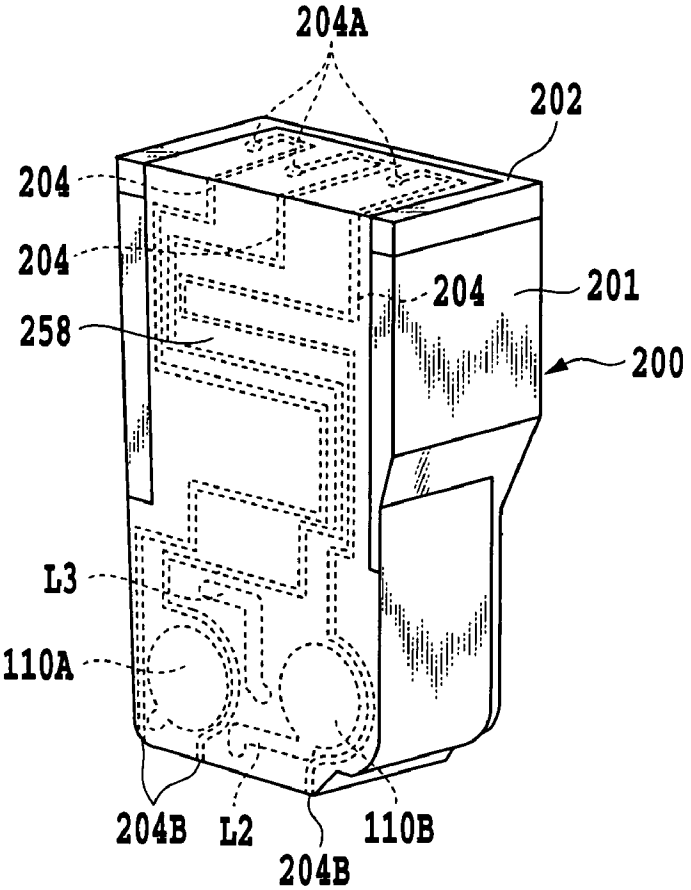
FIG. 15A and FIG. 15B are perspective views showing an ink cartridge according to a fifth embodiment of the present invention.
Figure 15A:
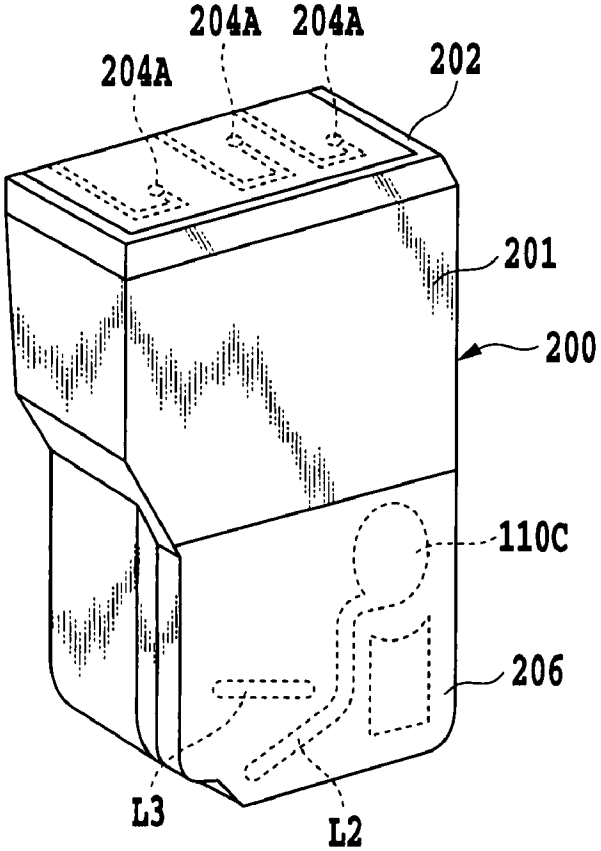

FIG. 15A and FIG. 15B are perspective views showing an ink cartridge according to a fifth embodiment of the present invention. The ink cartridge according to the present embodiment has the same configuration as that of the embodiment of FIG. 12A and FIG. 12B, except for the passage pattern of the air communication passage 104.

As shown in FIG. 15A and FIG. 15B, the passage pattern according to the present embodiment has a zigzag shape in the side surface of the case 202 similar to the embodiment of FIG. 13 and FIG. 14, and also has a shape like a mountains or volleys serving as a part of a zigzag shape in the air communication passage 104 in the cover 202. This prevents ink leakage via the communication hole 104B in many more possible positions in comparison with the embodiment of FIG. 13 and FIG. 14. More specifically, even when the cartridge in the position shown in FIG. 15A and FIG. 15B is rotated by 90 degrees within the plane of the case 202 side surface formed with the surface where the air communication passage 104 is formed, ink leakage is prevented. Further, even when the cartridge in the position shown in FIG. 15A and FIG. 15B is rotated by 90 degrees within a plane perpendicular to the plane where the air communication passage 104 is formed (that is,in the position where the plane where the communication passage 104 is formed is located on top), the ink in the communication passage 104 is prevented from moving further. It should be noted that when the passage in the cover 202 is formed not in a single mountain or valley shape but in a zigzag shape containing a plurality of mountains or valleys similarly in the side surface, ink leakage is prevented even when the cartridge is rotated by 90 degrees in the position where the side surface where the communication passage 104 is formed is located at bottom.

(Another Embodiment)

The above-mentioned embodiments have been described for the case where the films are attached to the case, etc., by fusion bonding. However, the present invention is not limited to this. For example, another known method such as adhesive joining may be used.

Further, the above-mentioned embodiments have been described for an ink tank of a cartridge type capable of being mounted onto and dismounted from a printing apparatus such as a printer. However, the present invention is not limited to this configuration. The invention maybe applied to an ink tank integrated with a printing head or alternatively to a sub-tank, which are used in a fixed form in the printing apparatus.

As described above, according to the embodiments of the present invention, the surface of the ink tank onto which a film is attached so as to form a passage for a pressure regulator valve is the same as the surface onto which a part of a film is attached so as to form an air communication passage. Thus, these two processes of attaching the two films are performed in a single process step of attaching the films onto a single surface, and hence the position setting, etc., in a film fusion bonding device is simplified.

As a result, an ink tank having a configuration in which an air communication passage and a pressure regulator valve passage are formed by covering a film grooves can be manufactured in a simplified manufacturing process.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink tank having a supply outlet for supplying ink, a reserving chamber storing ink to be supplied via said supply outlet, a pressure regulator valve located inside a passage connecting said reserving chamber with said supply outlet to operate on the basis of a pressure difference between the reserving chamber side and the supply outlet side, and an air vent formed to communicate with said reserving chamber through a case member from which said ink tank is composed, said ink tank comprising:

a concave portion formed in one surface of said ink tank for forming a passage of said pressure regulator valve; and a groove one end of which connects with said air vent, said groove being formed in and along a surface on which said air vent is formed and said one surface of said ink tank, wherein film attached to said surface of said ink tank and to said one surface of said ink tank covers said concave portion, said air vent, and said groove, except other end of said groove, together, so that said passage of said pressure regulator valve and an air communication passage are formed; and wherein said other end of said groove forming said air communication passage is located at a surface at which said supply outlet is located.

2. An ink tank as claimed in claim 1, wherein the film forming said pressure regulator valve passage and the film forming said air communication passage are made of same material.

3. An ink tank as claimed in claim 1, wherein the film forming said pressure regulator valve passage and the film forming said air communication passage form a single film.

4. An ink tank as claimed in claim 1, wherein a direction in which the groove forming said air communication passage elongates has a component of a horizontal direction, a component of a vertical direction and respective components opposite to said horizontal and vertical directions, with respect to one position of said ink tank.

* * * * *